US010340635B1

(12) United States Patent
Lee

(10) Patent No.: US 10,340,635 B1
(45) Date of Patent: Jul. 2, 2019

(54) PLUGGABLE AND UNPLUGGABLE DEVICE AND HANDLE FOR THE SAME

(71) Applicant: Getac Technology Corporation, Hsinchu County (TW)

(72) Inventor: Kun-Cheng Lee, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 0 days.

(21) Appl. No.: 16/038,649

(22) Filed: Jul. 18, 2018

(51) Int. Cl.
*H01R 13/633* (2006.01)

(52) U.S. Cl.
CPC ..... *H01R 13/6335* (2013.01); *H01R 2201/06* (2013.01)

(58) Field of Classification Search
CPC ..... H01R 13/62961; H01R 13/62933; H01R 13/62938; H01R 13/62955; H01R 13/62988; H01R 12/51; H01R 13/6335; H01R 2201/06; H01R 13/6283; Y10S 439/945; Y10S 439/946
USPC ..... 439/157, 160, 377, 476.1, 945, 946
See application file for complete search history.

(56) References Cited

U.S. PATENT DOCUMENTS 5,309,325 A * 5/1994 Dreher ..... H05K 7/1409 361/754
6,981,886 B1 * 1/2006 Co ..... H01R 13/62988 439/152
7,594,638 B2 9/2009 Chan et al.
7,616,435 B2 11/2009 Wang
8,986,024 B2 * 3/2015 Ikeda ..... H01H 9/102 200/332
9,270,317 B2 * 2/2016 Huang ..... H04B 1/38
9,304,549 B2 4/2016 Siddiqui
10,096,939 B2 * 10/2018 Chikusa ..... H01R 13/28
(Continued)

FOREIGN PATENT DOCUMENTS

CN 203859957 U 10/2014
CN 204217269 U 3/2015
(Continued)

OTHER PUBLICATIONS

Taiwan Patent Office, "Office Action", dated Nov. 8, 2018, Taiwan.

*Primary Examiner* — Travis S Chambers
(74) *Attorney, Agent, or Firm* — Locke Lord LLP; Tim Tingkang Xia, Esq.

(57) ABSTRACT

A pluggable and unpluggable device and a handle for the same are provided. The pluggable and unpluggable device includes a carrier, a shaft disposed at the carrier, and a handle movably mounted on the shaft and adapted to engage with and pull out, from an apparatus, the pluggable and unpluggable device in an engaged state and a pulled-out state respectively, alternately and repeatedly. The handle includes a handle body, a guide tunnel disposed in the handle body, and an engaging portion disposed on the handle body. The handle body fits around the shaft by the guide tunnel to thereby slide or rotate relative to the shaft. The engaging portion engages with and escapes from the apparatus as the handle body slides relative to the shaft by the guide tunnel. Therefore, the handle is unlikely to sever, capable of being locked and unlocked, one-piece and thus structurally simple, and space-efficient.

9 Claims, 6 Drawing Sheets

(56) References Cited

U.S. PATENT DOCUMENTS

2005/0208806 A1* 9/2005 Oila ..... H01R 13/62933
439/160

FOREIGN PATENT DOCUMENTS

TW I374001 B 10/2012
TW I623692 B 5/2018

* cited by examiner

PLUGGABLE AND UNPLUGGABLE DEVICE AND HANDLE FOR THE SAME

BACKGROUND OF THE INVENTION

Field of the Invention

The present disclosure relates to handles for pulling out pluggable and unpluggable devices and, more particularly, to a pluggable and unpluggable device and a handle for the same.

Description of the Prior Art

Pluggable and unpluggable devices are inserted into electronic products in order to be operated or pulled out of electronic products in order to be carried.

The pluggable and unpluggable devices may deny any grip to any user who wants to pull them out. In view of this, leashes pull-oriented objects are provided and gripped by users to pull the pluggable and unpluggable devices out of the electronic products.

Conventional pull-oriented objects fall into two categories: leashes and multi-piece handles. Both, however, have room for improvement.

Leashes are cheap advantageously but sever readily after long use or because of frequent pulls. Moreover, leashes cannot be locked and unlocked between a pluggable and unpluggable device and an electronic product.

Multi-piece handles are capable of being locked and unlocked and seldom sever. However, as the name suggests, multi-piece handles are structurally intricate and take up much space. Furthermore, multi-piece handles are likely to malfunction because of their intricate structure.

Therefore, it is important to provide a solution to the aforesaid drawbacks of the prior art.

SUMMARY OF THE INVENTION

It is an objective of the present disclosure to provide a pluggable and unpluggable device and a handle for the same. The handle mounted on the pluggable and unpluggable device is capable of being locked and unlocked, unlikely to sever, single-piece and thus structurally simple, and space-efficient.

In order to achieve the above and other objectives, the present disclosure provides a handle, adapted to engage with and pull out, from an apparatus, a pluggable and unpluggable device in an engaged state and a pulled-out state respectively, alternately and repeatedly and mounted on a shaft of the pluggable and unpluggable device, the handle comprising: a handle body; a guide tunnel disposed in the handle body, wherein the handle body fits around the shaft by the guide tunnel to thereby slide or rotate relative to the shaft; and an engaging portion disposed on the handle body to engage with the apparatus and escape from the apparatus as the handle body slides relative to the shaft by the guide tunnel.

The present disclosure also provides a pluggable and unpluggable device. The pluggable and unpluggable device is sunk into and accommodated in a space made by an apparatus after docking at the apparatus by at least a connector.

The present disclosure further provides a pluggable and unpluggable device, inserted into an apparatus, and comprising: a carrier; a shaft disposed at the carrier; and a handle.

The handle comprises: a handle body; a guide tunnel disposed in the handle body and having a first end and a second end, wherein the handle body fits around the shaft by the guide tunnel to thereby slide or rotate relative to the shaft; and an engaging portion disposed on the handle body, wherein the engaging portion engages with the apparatus and escapes from the apparatus as the handle body slides relative to the shaft by the guide tunnel.

The shaft corresponds in position to and is at the first end such that the engaging portion engages with the apparatus as soon as the handle slides in a direction. The shaft corresponds in position to and is at the second end such that the engaging portion escapes from the apparatus as soon as the handle slides in an opposite direction.

Compared with the prior art, the present disclosure has advantages as follows: the handle mounted on the pluggable and unpluggable device is unlikely to sever, capable of being locked and unlocked, one-piece and thus structurally simple, and space-efficient.

DETAILED DESCRIPTION OF THE EMBODIMENTS

Figure 1:
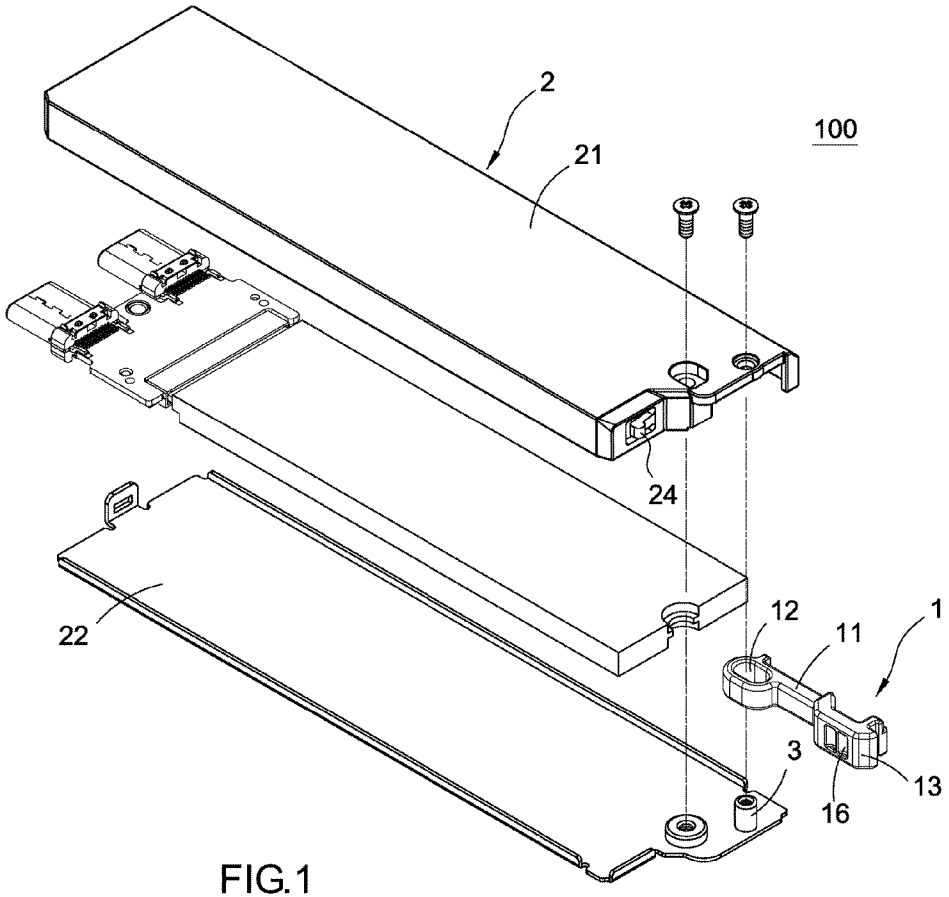
FIG. 1 is an exploded view of a pluggable and unpluggable device of the present disclosure.

Technical features of the present disclosure are illustrated by accompanying drawings and described below. However, the accompanying drawings serve as references and are illustrative rather than restrictive of the present disclosure.

As shown in FIG. 1 through FIG. 5, the present disclosure provides a pluggable and unpluggable device and a handle for the same. The pluggable and unpluggable device 100 is pluggably and unpluggably inserted into an apparatus 700. The pluggable and unpluggable device 100 comprises: a carrier 2, a shaft 3 disposed at the carrier 2, and a handle 1 movably mounted on the shaft 3. The pluggable and unpluggable device 100 preferably comprises a resilient protruding element 24. A user pulls the pluggable and unpluggable device 100 out of the apparatus 700 by the handle 1.

The carrier 2 is any object capable of carrying. In this embodiment, the carrier 2 comprises a first casing 21, a second casing 22, and an inner body (not denoted by any reference numeral). The first casing 21 and the second casing 22 are coupled together. The inner body of pluggable and unpluggable device 100 is enclosed within and between the first casing 21 and the second casing 22 and thus fixed in place.

The shaft 3 is disposed at any point on the carrier 2 by any means of fixing. In this embodiment, the shaft 3 is fixed between one side (for example, bottom side) of the first casing 21 and one side (for example, bottom side) of the second casing 22. As shown in the diagrams, the shaft 3 is positioned proximate to one end of each of the sides (for example, bottom sides).

The handle 1 is adapted to engage with and pull out the pluggable and unpluggable device 100 in an engaged state (shown in FIG. 3) and a pulled-out state (shown in FIG. 5) respectively, alternately and repeatedly. The handle 1 comprises a handle body 11, a guide tunnel 12 and an engaging portion 13, which are described below.

Figure 2:
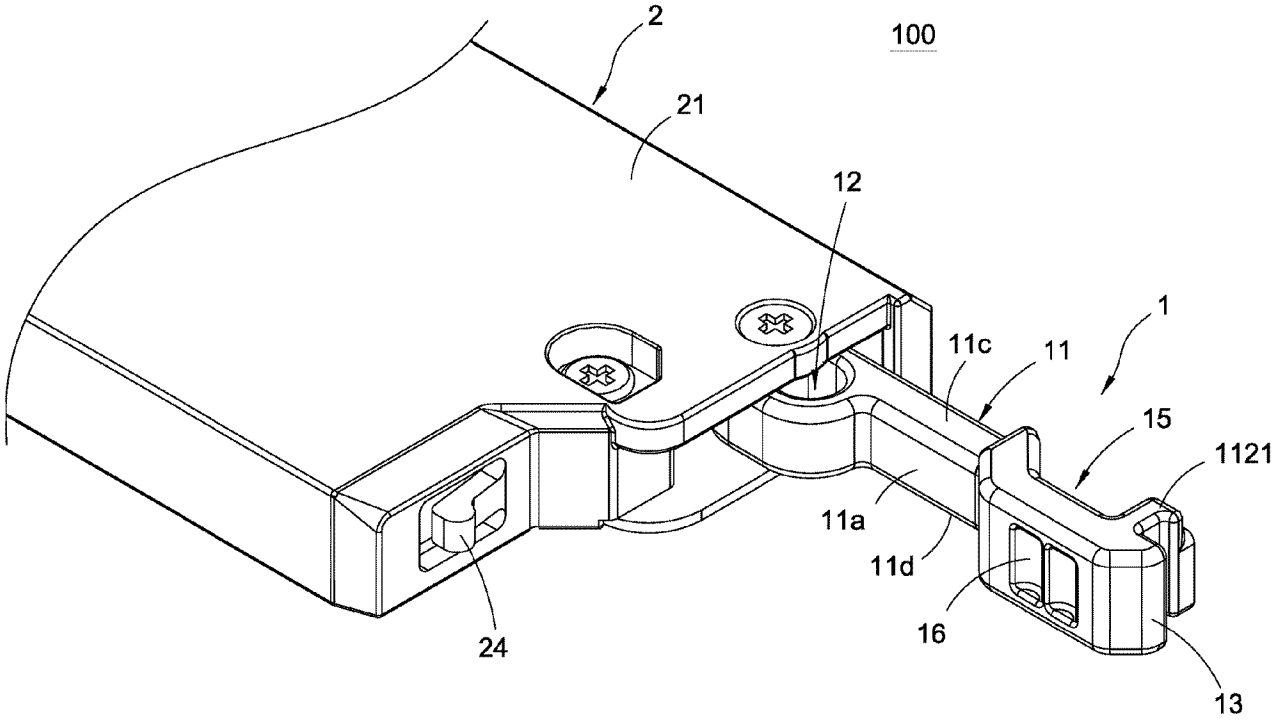
FIG. 2 is a partial enlarged perspective view of the pluggable and unpluggable device assembled according to the present disclosure.
Figure 3:
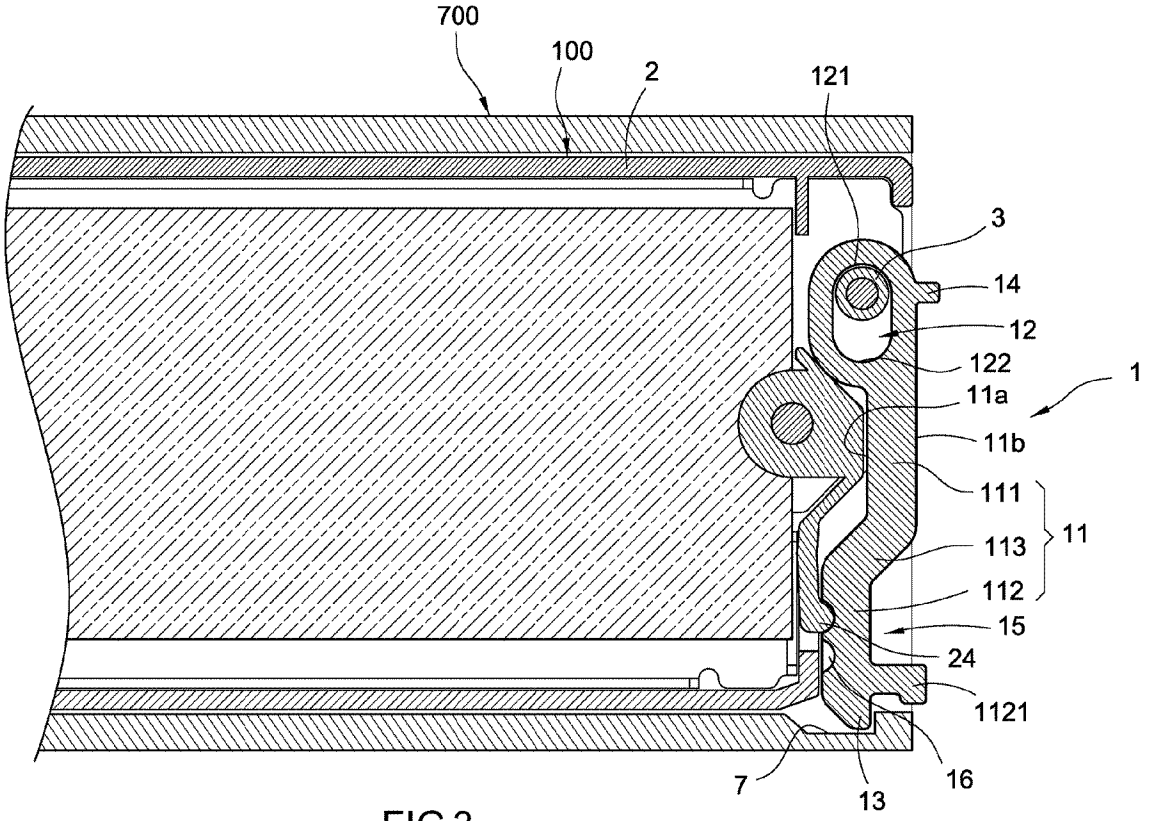
FIG. 3 is a partial cross-sectional view of the pluggable and unpluggable device of the present disclosure, showing that a handle is in an engaged state.

The handle body 11 is made of any material, but the present disclosure is not restrictive thereof. The handle body 11 is preferably made of a flexible material. As shown in FIG. 2 and FIG. 3, the handle body 11 has two opposing end portions (not denoted by any reference numerals.) The handle body 11 further has an inner side 11*a* and an outer side 11*b* which oppose each other as well as a top side 11*c* and a bottom side 11*d* which oppose each other. The inner side 11*a* and the outer side 11*b* are connected between two edges of the top side 11*c* and between two edges of the bottom side 11*d*, respectively. Preferably, the handle body 11 comprises a first segment 111, a second segment 112, and a bend segment 113 connected between the first segment 111 and the second segment 112; hence, the bend segment 113 ensures that the first segment 111 and the second segment 112 are not collinear.

The guide tunnel 12 and the engaging portion 13 are each disposed at any point at the handle body 11. In this embodiment, the guide tunnel 12 and the engaging portion 13 are disposed at the two end portions of the handle body 11, respectively. The guide tunnel 12 is disposed between the top side 11*c* and the bottom side 11*d* and corresponds in position to the first segment 111. The second segment 112 functions as a grip segment of the handle 1. The engaging portion 13 extends in the lengthwise direction of the handle body 11.

The guide tunnel 12 has a first end 121 and a second end 122 in the lengthwise direction of the handle body 11. The handle body 11 fits around the shaft 3 by the guide tunnel 12 such that the handle body 11 can slide or rotate relative to the shaft 3.

Figure 4:
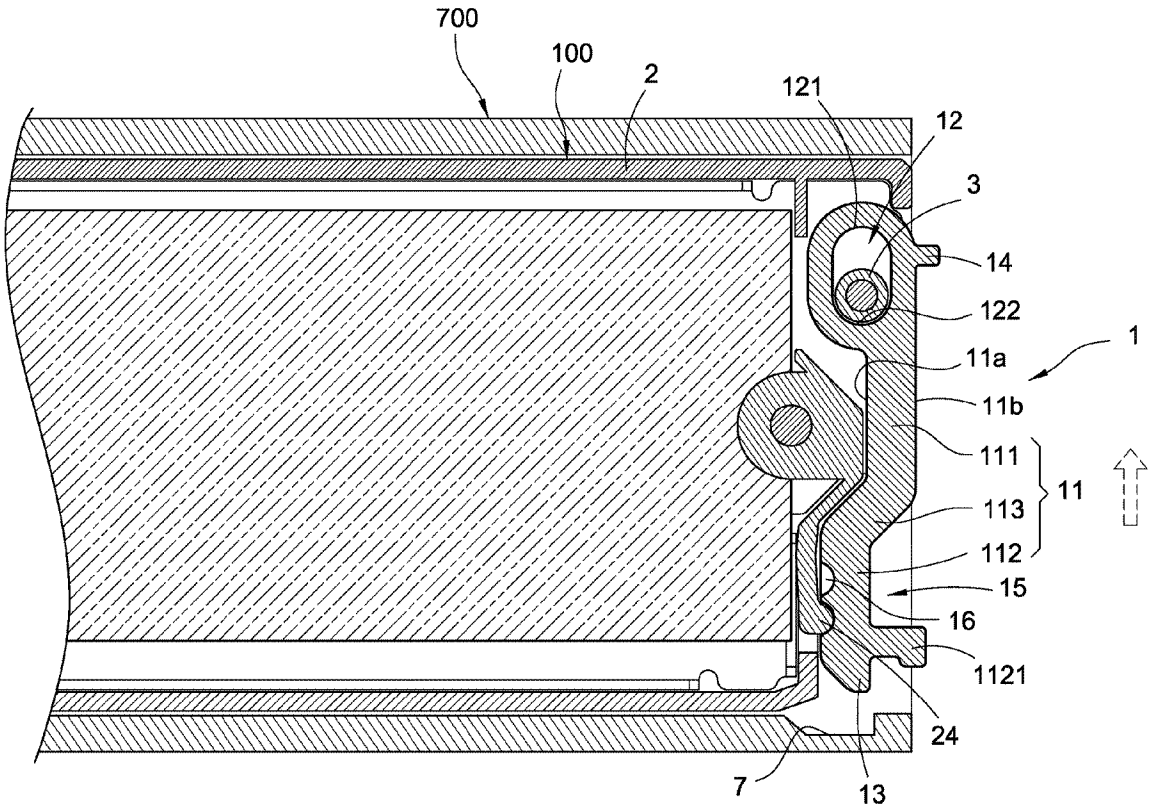
FIG. 4 is a partial cross-sectional view of the pluggable and unpluggable device of the present disclosure, showing that the handle has been moved and slid.

The handle body 11 slides in two opposite directions relative to the shaft 3; hence, the engaging portion 13 engages with the engaged portion 7 of the apparatus 700 (in the engaged state shown in FIG. 3) and escapes from the engaged portion 7 of the apparatus 700 (as shown in FIG. 4.)

As shown in FIG. 3 through FIG. 6, when the pluggable and unpluggable device 100 with a solid state disk docks at the apparatus 700 by two USB Type-C connectors, the pluggable and unpluggable device 100 will be sunk into and accommodated in a space made by the apparatus 700. Particularly, the apparatus 700 communicates with the solid state disk via the two USB Type-C connectors, the solid state disk for storage is carried and enclosed by the carrier 2 and the two USB Type-C connectors are soldered on a PCB of the pluggable and unpluggable device 100. Furthermore, the pluggable and unpluggable device 100 is capable of being sunk into and accommodated in a space made by the apparatus 700 after docking at the apparatus 700 by the two male USB Type-C connectors docking at two corresponding female USB Type-C connectors on a PCB of the apparatus 700. After that, if the engaging portion 13 of the handle 1 engages with the engaged portion 7 of the apparatus 700, the handle 1 will be in the engaged state shown in FIG. 3, whereas the shaft 3 will correspond in position to and be at the first end 121 of the guide tunnel 12. Pulling the pluggable and unpluggable device 100 out entails: sliding the handle 1 in a first direction (indicated by the dashed-line arrow shown in FIG. 4) to not only allow the shaft 3 to correspond in position to and be at the second end 122 of the guide tunnel 12 but also allow the engaging portion 13 to escape from the engaged portion 7 and thus be unlocked, thereby allowing the handle 1 to be in a rotatable state shown in FIG. 4; then turning around the handle 1 outward (i.e., in the direction indicated by the dashed-line arrow shown in FIG. 5) on the shaft 3 functioning as the center of rotation such that the handle 1 is in the pulled-out state shown in FIG. 5; finally, gripping the grip segment of the handle 1 with fingers to easily pull, in a pulling direction (indicated by the dashed-line arrow shown in FIG. 6) opposite the insertion direction, the pluggable and unpluggable device 100 out of the apparatus 700.

Figure 5:
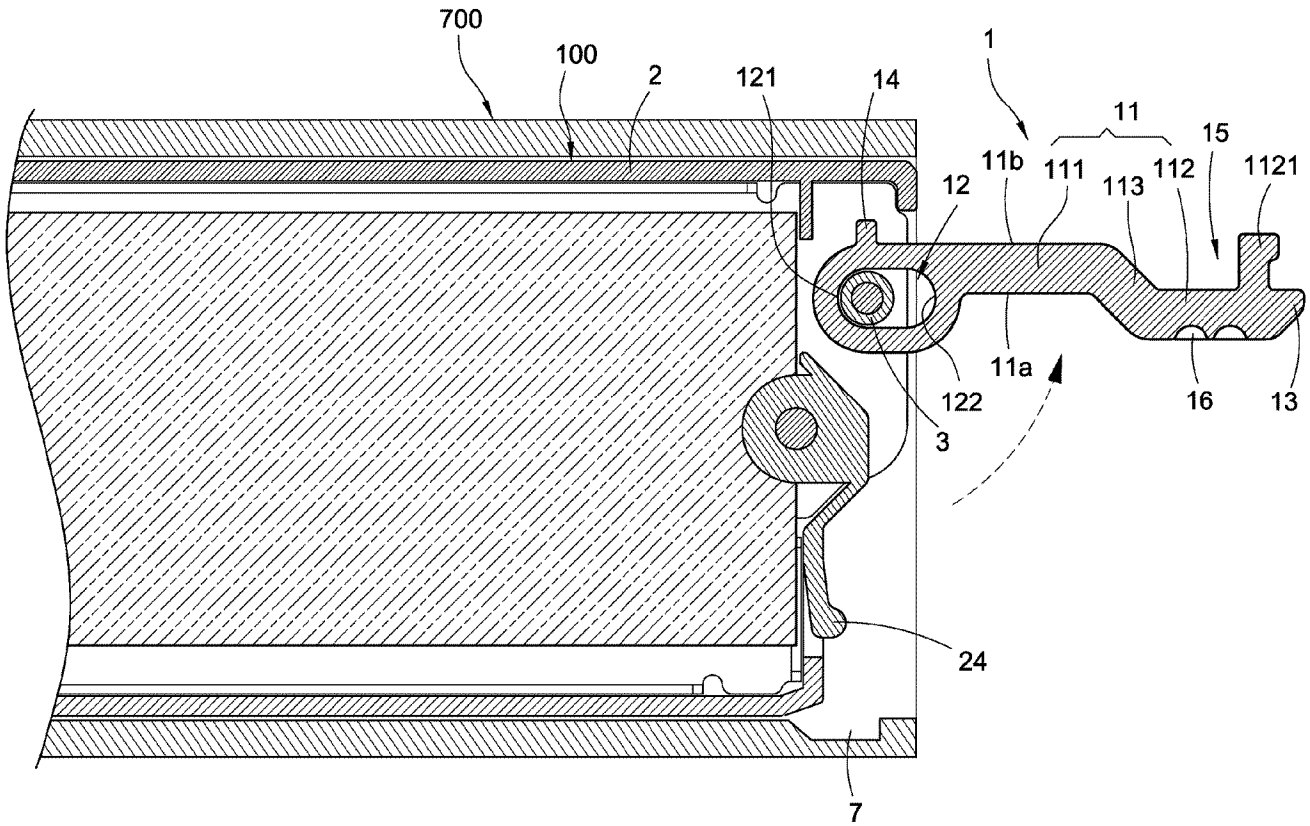
FIG. 5 is a partial cross-sectional view of the pluggable and unpluggable device of the present disclosure, showing that the handle is in a pulled-out state after being rotated.

After the pluggable and unpluggable device 100 has been inserted into the apparatus 700 again, the user turns around the handle 1 inward (i.e., in the direction opposite to the direction indicated by the dashed-line arrow shown in FIG. 5) on the shaft 3 functioning as the center of rotation such that the inner side 11*a* of the handle body 11 is positioned proximate to one end (or the inner body) of the carrier 2. Afterward, the user slides the handle 1 in a second direction (i.e., in the direction opposite to the direction indicated by the dashed-line arrow shown in FIG. 4) such that the shaft 3 corresponds in position to and be at the first end 121 of the guide tunnel 12 again, thereby allowing the engaging portion 13 to engage with the engaged portion 7 of the apparatus 700 and be locked.

Figure 6:
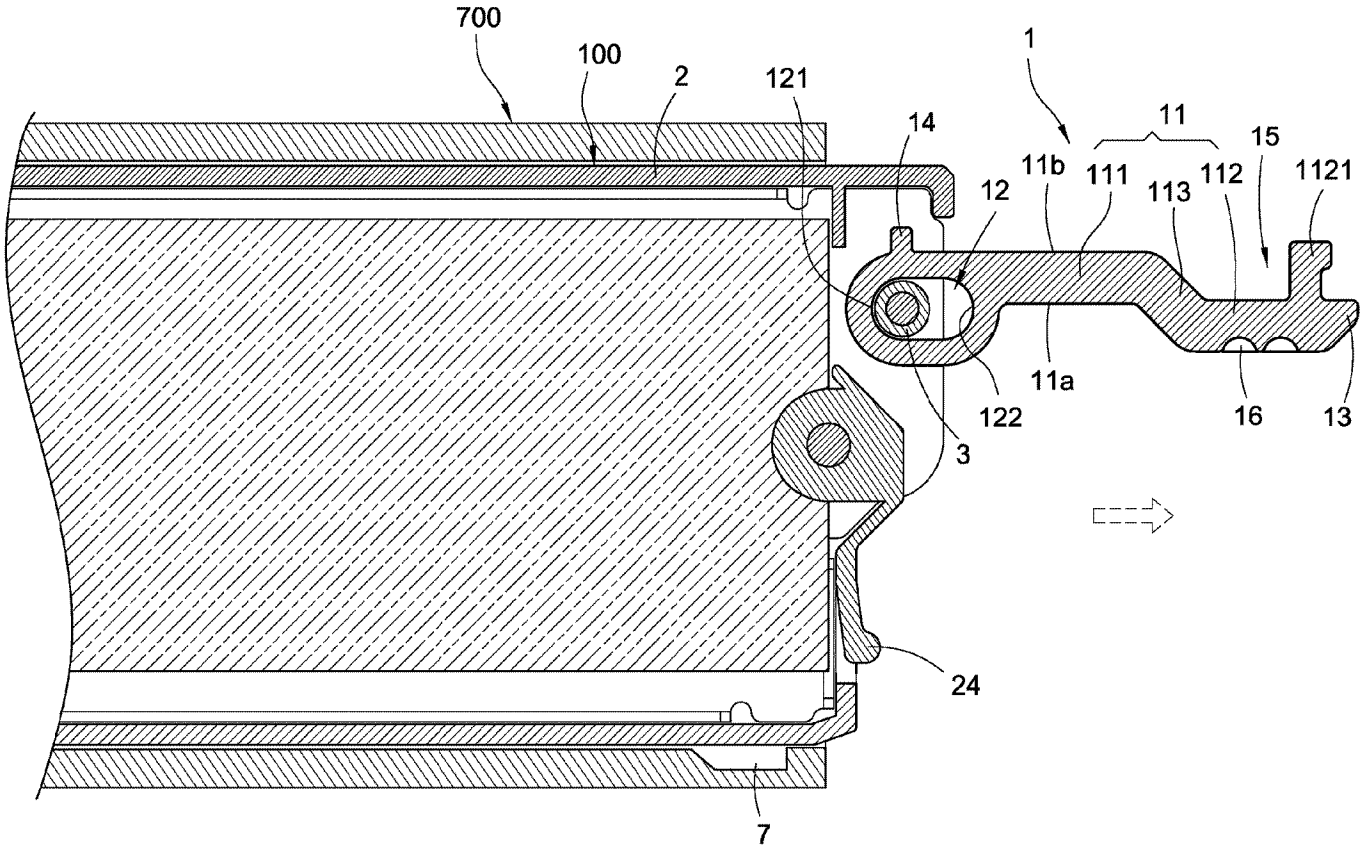
FIG. 6 is a partial cross-sectional view of the pluggable and unpluggable device of the present disclosure, with the pluggable and unpluggable device pulled out of an apparatus by the handle.

As shown in FIG. 5 and FIG. 6, a protruding portion 1121 is protrudingly disposed on the outer side 11*b* of the second segment 112 of the handle body 11 of the handle 1 such that a sunk portion 15 is formed between the bend segment 113, the second segment 112, and one side of the protruding portion 1121, thereby allowing the user to grip the grip segment easily. The engaging portion 13 protrudes from the other side of the protruding portion 1121.

As shown in FIG. 3 through FIG. 5, a protruding key 14 protrudes from the handle body 11 of the handle 1. Preferably, the protruding key 14 corresponds in position to the guide tunnel 12, protrudes from the outer side 11*b* of the first segment 111, and is positioned proximate to the first end 121 of the guide tunnel 12; hence, the protruding key 14 is eccentrically positioned relative to the guide tunnel 12. Therefore, if the user moves the protruding key 14 in the first direction shown in FIG. 4, the user will not only slide the handle 1 horizontally in the first direction and thus disable the engagement (i.e., unlock) but also turn the handle 1 around outward on the shaft 3 functioning as the center of rotation such that the handle 1 is in the pulled-out state. As shown in FIG. 4, when the handle 1 slides in the first direction and thus has its engagement disabled, the shaft 3 corresponds in position to and is at the second end 122 of the guide tunnel 12 to ensure separation of the protruding key 14 being subjected to an external force and the shaft 3 functioning as the center of rotation, so as to facilitate rotation of the handle 1.

As shown in FIG. 2 through FIG. 4, the carrier 2 (in addition to being fixed in place by the shaft 3) is preferably fixed in place by a fixing component (not denoted by any reference numeral) fixed in place between the side of the first casing 21 and the side of the second casing 22. The fixing component is not only fixed between the two ends of the sides but is also fixed to the resilient protruding element 24

(shown in FIG. 3). A plurality of recesses 16 is disposed on the inner side 11*a* of the second segment 112 of the handle body 11 and corresponds in position to the resilient protruding element 24. As soon as the handle 1 moves in the first direction or the second direction, the resilient protruding element 24 snap-engages with one of the recesses 16 resiliently; hence, the handle 1 feels rotatable to the touch and generates engagement-induced sounds.

Compared with the prior art, the present disclosure has advantages described below. Unlike its conventional counterpart, i.e., a conventional leash, the handle 1 is insusceptible to a rupture, especially if it is made of a flexible material, not to mention that the flexible material further enhances the gripping feel and gripping stability of the handle 1. During the sliding of the handle 1, the engaging portion 13 engages with the apparatus 700 to thereby achieve locking or escapes from the apparatus 700 to thereby achieve unlocking. The handle 1 is one-piece, rather than conventionally multi-piece; hence, the handle 1 is structurally simple, takes up little space, and is unlikely to malfunction.

The other advantages of the present disclosure are described below. The sunk portion 15 allows the user to grip the grip segment of the handle 1 easily. A mere push exerted by the user on the protruding key 14 in the first direction not only allows the handle 1 to be moved and unlocked but also allows the handle 1 to be turned around outward and driven to the pulled-out state. The resilient protruding element 24 and the plurality of the recesses 16 together not only allow the handle 1 to feel segmentally rotatable to the touch in the course of its slide to thereby allow the user to confirm whether the handle 1 has been locked or unlocked, but also allow the handle 1 to generate engagement-induced sounds.

The descriptions above are just illustrative of preferred practicable embodiments of the present disclosure and thus are not restrictive of the scope of the claims of the present disclosure. Hence, all equivalent structural changes made to the aforesaid embodiments according to the specification and drawings of the present disclosure shall fall within the scope of the claims of the present disclosure.

What is claimed is:

1. A handle mounted on a shaft of a pluggable and unpluggable device, wherein the handle is adapted to engage with and pull out, from an apparatus, the pluggable and unpluggable device in an engaged state and a pulled-out state respectively, alternately and repeatedly, the handle comprising:

a handle body;

a guide tunnel disposed in the handle body, wherein the handle body fits around the shaft by the guide tunnel to thereby slide or rotate relative to the shaft; and an engaging portion disposed on the handle body, wherein the engaging portion engages with the apparatus and escapes from the apparatus as the handle body slides relative to the shaft by the guide tunnel, wherein the handle body has two opposing end portions which the guide tunnel and the engaging portion are disposed at, respectively.

2. The handle of claim 1, wherein the handle body comprises a first segment, a second segment, and a bend segment connected between the first segment and the second segment, the first segment having the guide tunnel, with the second segment functioning as a grip segment of the handle and having the engaging portion.

3. The handle of claim 2, wherein a protruding portion is protrudingly disposed on the second segment such that a sunk portion is formed between the bend segment, the second segment, and a side of the protruding portion, so as to facilitate a grip.

4. The handle of claim 1, further comprising a protruding key protruding from the handle body and corresponding in position to the guide tunnel.

5. The handle of claim 4, wherein the guide tunnel has a first end and a second end, with the shaft corresponding in position to and being at the first end in the engaged state, the shaft corresponding in position to and being at the second end as soon as the engaging portion escapes from the apparatus, and the protruding key is positioned proximate to the first end.

6. A pluggable and unpluggable device, inserted into an apparatus, and comprising:

a carrier;

a shaft disposed at the carrier; and a handle comprising:

a handle body;

a guide tunnel disposed in the handle body and having a first end and a second end, wherein the handle body fits around the shaft by the guide tunnel to thereby slide or rotate relative to the shaft; and an engaging portion disposed on the handle body, wherein the engaging portion engages with the apparatus and escapes from the apparatus as the handle body slides relative to the shaft by the guide tunnel, wherein, the shaft corresponds in position to and is at the first end such that the engaging portion engages with the apparatus as soon as the handle slides in a direction, and the shaft corresponds in position to and is at the second end such that the engaging portion escapes from the apparatus as soon as the handle slides in an opposite direction, and wherein the handle body has two opposing end portions which the guide tunnel and the engaging portion are disposed at, respectively.

7. The pluggable and unpluggable device of claim 6, further comprising a resilient protruding element disposed at the carrier and a plurality of recesses disposed at the handle, the handle being positioned proximate to the carrier and sliding relative to the carrier, and the resilient protruding element snap-engaging with one of the plurality of recesses resiliently as soon as the handle slides relative to the carrier, rendering the handle nice to touch.

8. The pluggable and unpluggable device of claim 6, wherein the carrier comprises a first casing and a second casing coupled together, and the shaft is fixed between a side of the first casing and a side of the second casing.

9. The pluggable and unpluggable device of claim 6, wherein the handle further comprises a protruding key, with the handle body having an inner side and an outer side opposing the inner side, the inner side adjoining an end of the carrier, and the protruding key corresponds in position to the guide tunnel, protrudes from the outer side, and is positioned proximate to the first end.

* * * * *